US008661733B2

(12) United States Patent
Lee

(10) Patent No.: US 8,661,733 B2
(45) Date of Patent: Mar. 4, 2014

(54) ELECTRICAL DOOR-LOCKING DEVICE

(75) Inventor: Chul Lee, Incheon (KR)

(73) Assignee: The Korea Development Bank, Yeongdeungpo-Gu, Seoul (KR)

( * ) Notice: Subject to any disclaimer, the term of this patent is extended or adjusted under 35 U.S.C. 154(b) by 279 days.

(21) Appl. No.: 13/262,549

(22) PCT Filed: Apr. 1, 2010

(86) PCT No.: PCT/KR2010/002027

§ 371 (c)(1),
(2), (4) Date: Sep. 30, 2011

(87) PCT Pub. No.: WO2010/114326

PCT Pub. Date: Oct. 7, 2010

(65) Prior Publication Data

US 2012/0017517 A1 Jan. 26, 2012

(30) Foreign Application Priority Data

Apr. 2, 2009 (KR) ..... 10-2009-0028373

(51) Int. Cl.
*E05B 47/00* (2006.01)
*E05B 65/08* (2006.01)
*E06B 3/70* (2006.01)

(52) U.S. Cl.
USPC ..... 49/118; 49/116; 49/362

(58) Field of Classification Search
USPC ..... 49/116, 118, 360, 362; 105/282.1, 307, 105/308.1, 308.2, 310, 333, 339; 292/9, 12, 292/15, 23, 56, 57, 58, 63, 64, 201, 144, 1, 292/DIG. 1
See application file for complete search history.

(56) References Cited

U.S. PATENT DOCUMENTS

| | | | | | |
|---|---|---|---|---|---|
| 3,318,048 | A | * | 5/1967 | Odend'hal | 49/223 |
| 3,553,890 | A | * | 1/1971 | Stretton | 49/32 |
| 4,091,570 | A | * | 5/1978 | Favrel | 49/118 |
| 4,108,283 | A | * | 8/1978 | Mangel | 187/319 |
| 4,142,326 | A | * | 3/1979 | Schmitz | 49/118 |
| 4,198,786 | A | * | 4/1980 | Monot | 49/362 |

(Continued)

FOREIGN PATENT DOCUMENTS

| | | |
|---|---|---|
| JP | 2004-250946 | 9/2004 |
| KR | 10-0676550 | 1/2007 |

OTHER PUBLICATIONS

International Search Report mailed Nov. 16, 2010 for PCT/KR2010/002027.

*Primary Examiner* — Katherine Mitchell
*Assistant Examiner* — Justin Rephann
(74) *Attorney, Agent, or Firm* — Heedong Chae; East West Law Group

(57) ABSTRACT

An electrical door-locking device includes screws which are rotatable in a forwards and backwards direction, and are placed in line on one side of a door frame in the direction in which the electrical door main body slides; locking hooks located adjacent to the screws; and a sliding unit equipped with a rotatably-provided locking lever having a latch for latching onto the locking hooks when the electrical door main body is closed and is equipped with a locking-lever-pressing part for pressing the locking lever such that the latch of the locking lever unlatches from the locking hooks, and one end of which is rotatably linked to the screws and the other end of which is linked to the electrical door main body.

17 Claims, 5 Drawing Sheets

(56) References Cited

U.S. PATENT DOCUMENTS

| | | | | | |
|---|---|---|---|---|---|
| 4,454,931 | A * | 6/1984 | Leiner et al. | 187/319 |
| 4,457,108 | A * | 7/1984 | Kuschel et al. | 49/213 |
| 4,605,108 | A | 8/1986 | Monot | |
| 4,882,876 | A * | 11/1989 | Daugirdas | 49/141 |
| 4,901,474 | A * | 2/1990 | Bayard et al. | 49/26 |
| 5,077,938 | A | 1/1992 | Moreuil | |
| 5,148,631 | A * | 9/1992 | Bayard et al. | 49/449 |
| 5,263,280 | A * | 11/1993 | Dilcher | 49/212 |
| 5,341,598 | A * | 8/1994 | Reddy | 49/362 |
| 5,456,504 | A * | 10/1995 | Brillant | 292/63 |
| 5,483,769 | A * | 1/1996 | Zweili | 49/118 |
| 5,755,060 | A * | 5/1998 | Zweili | 49/449 |
| 5,826,377 | A * | 10/1998 | Simson et al. | 49/362 |
| 5,893,236 | A * | 4/1999 | Krbec et al. | 49/118 |
| 5,927,015 | A * | 7/1999 | Ghosn et al. | 49/291 |
| 6,009,668 | A * | 1/2000 | Reddy | 49/280 |
| 6,032,416 | A * | 3/2000 | Springer et al. | 49/119 |
| 6,094,867 | A * | 8/2000 | Reddy | 49/280 |
| 6,134,838 | A * | 10/2000 | Reddy | 49/362 |
| 6,189,265 | B1 * | 2/2001 | Fink | 49/118 |
| 6,282,970 | B1 * | 9/2001 | Oakley | 74/89.14 |
| 6,446,389 | B1 * | 9/2002 | Heffner et al. | 49/280 |
| 6,662,500 | B2 * | 12/2003 | Inage | 49/116 |
| 6,688,042 | B2 * | 2/2004 | Stojc et al. | 49/118 |
| 6,718,694 | B2 * | 4/2004 | Stojc et al. | 49/362 |
| 6,739,092 | B2 * | 5/2004 | Heffner et al. | 49/285 |
| 6,854,399 | B2 * | 2/2005 | Inage | 105/341 |
| 6,863,001 | B2 * | 3/2005 | Inage | 105/341 |
| 6,941,701 | B2 * | 9/2005 | Inage | 49/449 |
| 7,004,516 | B2 * | 2/2006 | Stojc | 292/201 |
| 7,971,391 | B2 * | 7/2011 | Harie | 49/120 |
| 8,113,552 | B2 * | 2/2012 | Ritt et al. | 292/201 |
| 8,136,299 | B2 * | 3/2012 | Inage | 49/118 |
| 2001/0013200 | A1 * | 8/2001 | Fink | 49/120 |
| 2002/0194783 | A1 * | 12/2002 | Stojc et al. | 49/118 |
| 2002/0194784 | A1 * | 12/2002 | Stojc et al. | 49/118 |
| 2003/0126797 | A1 * | 7/2003 | Inage | 49/118 |
| 2004/0211121 | A1 * | 10/2004 | Inage | 49/449 |
| 2006/0174540 | A1 * | 8/2006 | Oberleitner | 49/118 |
| 2011/0041408 | A1 * | 2/2011 | Lopez Saez et al. | 49/260 |
| 2011/0308164 | A1 * | 12/2011 | Terasaki et al. | 49/360 |
| 2012/0011778 | A1 * | 1/2012 | Kong | 49/503 |
| 2012/0073208 | A1 * | 3/2012 | Lee | 49/449 |

* cited by examiner

ELECTRICAL DOOR-LOCKING DEVICE

CROSS REFERENCE TO RELATED APPLICATION

This application claims the priority of Korean Patent Application No. 10-2009-0028373, filed on Apr. 2, 2009 in the KIPO (Korean Intellectual Property Office), the disclosure of which is incorporated herein in their entirety by reference. Further, this application is the National Phase application of International Application No. PCT/KR2010/002027, filed on Apr. 1, 2010, which designates the United States and was published in Korean. Each of these applications is hereby incorporated by reference in their entirety into the present application.

FIELD OF THE INVENTION

The present invention relates, in general, to an electric door lock and an electric door having the same and, more particularly, to an electric door lock which has a simple structure, ensures the reliability of a locking function, reduces a danger of a failure and an operation error, and is easy to fabricate and maintain, saving the cost for the fabrication and maintenance relative to the cost taken in the related art, and an electric door having the same.

DESCRIPTION OF THE RELATED ART

In case of a railway train, a currently available electric door (auto door) is operated such that when a train arrives at a station, the door is opened and closed for boarding or alighting of passengers following the driver's manipulation of an actuation switch, which is performed by the driver who is seeing the passengers boarding on or alighting from the railway train.

Here, if a passenger or an object gets caught in the door during the closing of the electric door, the electric door cannot be completely closed. In this case, the driver is informed of such situation or information through a display or an alarm means, and the driver who recognized the state of the door being not completely closed repeatedly manipulates the actuation switch to open and close the electric door until the electric door is completely closed.

In the meantime, if the railway train is stopped to run owing to a fire, a failure, etc. of the train, or passengers should escape from the train because an emergency situation occurs in the train, the driver should directly manipulate the actuation switch to open the door after checking the state of the railway tracks, or otherwise the passengers should directly manually manipulate a manual opening/closing means, which was mounted in the proximity of the electric door, to open the door.

However, if the situation is that the railway train is running, or the state of the railway tracks is dangerous, or otherwise if nevertheless the situation is not an emergency state, the passengers can open the electric door even with their less effort, a very dangerous situation can be caused. Thus, there is a need for an electric door lock.

In order to provide a reliable locking function, a conventional electric door lock, which was disclosed in U.S. Pat. No. 5,077,938, includes a locking roller, a locking finger member, a guide finger member, a locking roller slide channel, a roller keeper, a carriage, and the like.

However, the conventional electric door lock having the above-mentioned configuration has a problem of increased cost of fabrication and maintenance because of numerous, complex parts.

DISCLOSURE OF INVENTION

Technical Problem

Accordingly, the present invention has been made keeping in mind the above problems occurring in the related art, and the present invention is intended to propose to an electric door lock which has a simple structure, ensures the reliability of a locking function, reduces a danger of a failure and an operation error, and is easy to fabricate and maintain, saving the cost for the fabrication and maintenance relative to the cost taken in the related art, and an electric door having the same.

Solution to Problem

In order to achieve the above object, according to one aspect of the present invention, there is provided an electric door lock adapted to at least one electric door body that is able to slide, the electric door lock including: a pair of screws capable of rotating forwards and rearwards and disposed parallel with each other in one side of a door frame in the direction in which the door body slides; a locking hook each provided in the proximity of the screws; and a sliding unit wherein one end thereof is rotatably connected to the screws and the other end thereof is connected to the door body, the sliding unit including a locking lever rotatably provided therein and having a latch for latching onto the locking hooks when the electric door is closed, and a locking lever-pressing part actuated to press the locking lever such that the latch of the locking lever unlatches from the locking hooks.

The locking lever may be elastically biased towards the direction against which the locking lever approaches the locking hook by means of e.g. a pressing spring member.

In addition, the locking lever may further include a locking lever roller that will come into contact with the locking lever-pressing part. The locking lever further comprises locking roller formed of a latch latching onto the locking hook. That is, the latch of the locking lever that will latch onto the locking hook may preferably be formed of a locking roller.

The locking hook may be provided in the proximity of the door frame or a screw-fixing housing adjacent to the screw.

According to the present invention, the electric door lock may further include a locking switch provided in the door frame for checking the locked state of the door body when the door body is closed, and a locking switch-pressing part actuated to operate a locking switch such that a locking signal is generated by the locking switch.

The sliding unit may include: a transfer nut rotatably screwed-coupled to the screw such that it is rotatable in the longitudinal direction of the screw; a transfer nut lump including the transfer nut, a support for the transfer nut, and the locking lever-pressing part; a transfer nut lump housing partially surrounding and supporting the transfer nut lump such that the transfer nut lump is rotatable at a certain angle; and a locking lever hinge rotating the locking lever at a certain angle in the direction perpendicular to the advancing-direction of the sliding unit.

The transfer nut lump housing may include: a housing body; and an opening that is formed to one side of the housing body such that the locking lever-pressing part is open towards the locking lever roller The locking hook may include: an inclined section provided in the outside thereof at a certain angle in the direction in which the electric door body is closed, such that a locking roller of the locking lever is smoothly coupled to the locking hook; and a vertical end formed at the utmost position of the inclined section such that the vertical end extends in the direction that intersects the direction in which the door body slides.

The sliding unit may further include: a hanger connected with the door body; a hanger roller connected to one side of the hanger and coupled to a hanger rail formed on the door frame such that it is able to roll along the hanger rail; and a link that connects and supports the other side of the hanger and the transfer nut lump housing.

The electric door lock of the present invention may include an emergency release mechanism having an emergency release roller and an emergency release roller plate to which the emergency release roller is mounted.

The door body, the screws, the locking hooks, the emergency release roller, the emergency release roller plate, and the sliding unit may be respectively provided in a single unit or a pair unit, in which both elements are symmetric with each other, on the door frame. Here, the opposite screws may respectively have threads extending opposite to each other, i.e., the pair of screws respectively have threads extending opposite to each other.

In addition, the electric door lock may further include a closing switch provided in the door body so as to generate a signal indicative of the closed state of the door body when the door body was closed.

A space in which the screw nut lump can move in the sliding direction of the door body or in the direction that intersects the sliding direction in connection with the screw nut lump housing may be further provided between the screw nut lump and the screw nut lump housing.

In another aspect of the present invention, there is provided an electric door having the electrical door lock having the above-mentioned configuration.

As set forth before, the electric door lock has a simple structure, ensures the reliability of a locking function, reduces a danger of a failure and an operation error, and is easy to fabricate and maintain, saving the cost for the fabrication and maintenance relative to the cost taken in the related art.

BRIEF DESCRIPTION OF THE DRAWINGS

The above and other objects, features and advantages of the present invention will be more clearly understood from the following detailed description when taken in conjunction with the accompanying drawings, in which.

DETAILED DESCRIPTION OF THE INVENTION

Figure 1:
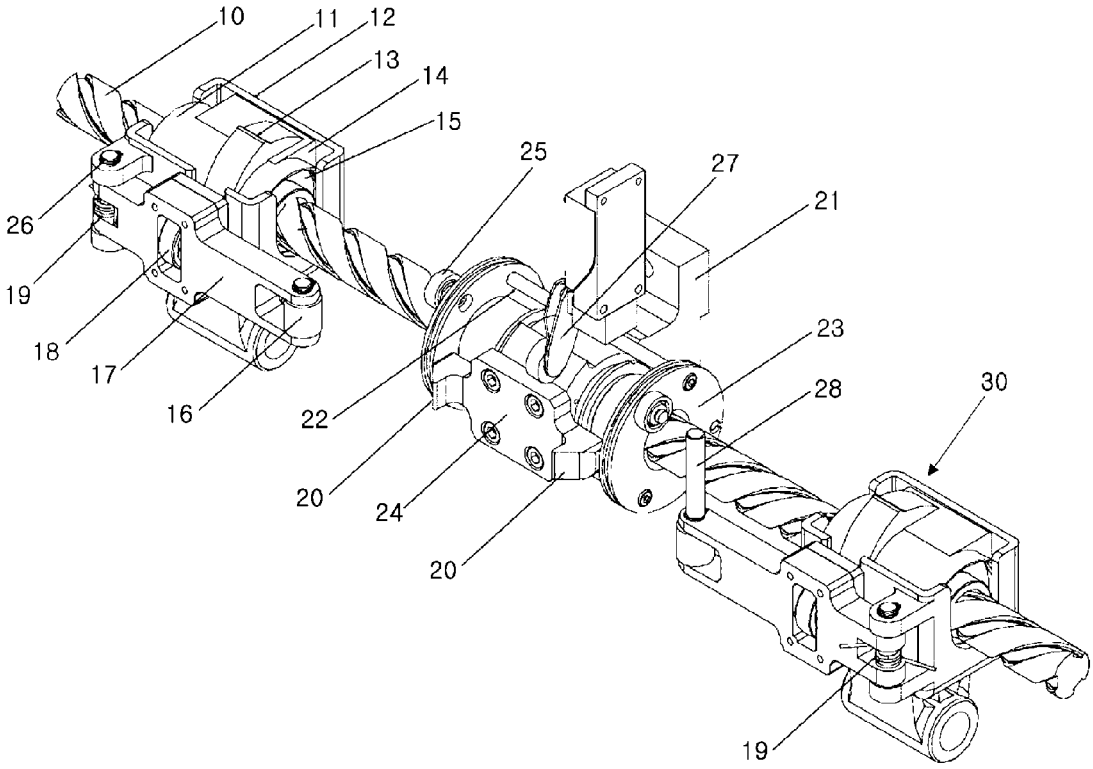
FIG. 1 is a perspective view showing an electric door lock according to an embodiment of the present invention when it is being closed.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 2:
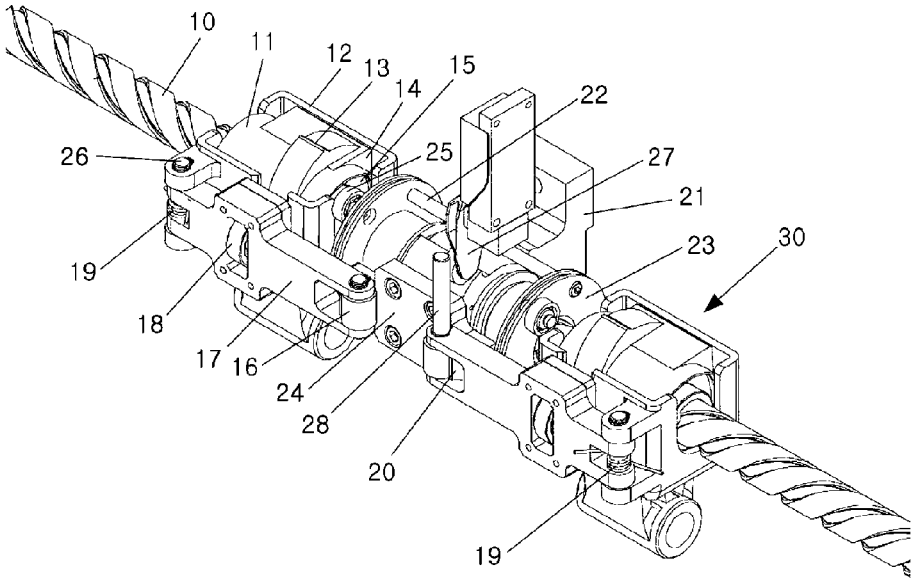
FIG. 2 is a perspective view showing the electric door lock according to an embodiment of the present invention when it was completely closed.
Figure 3:
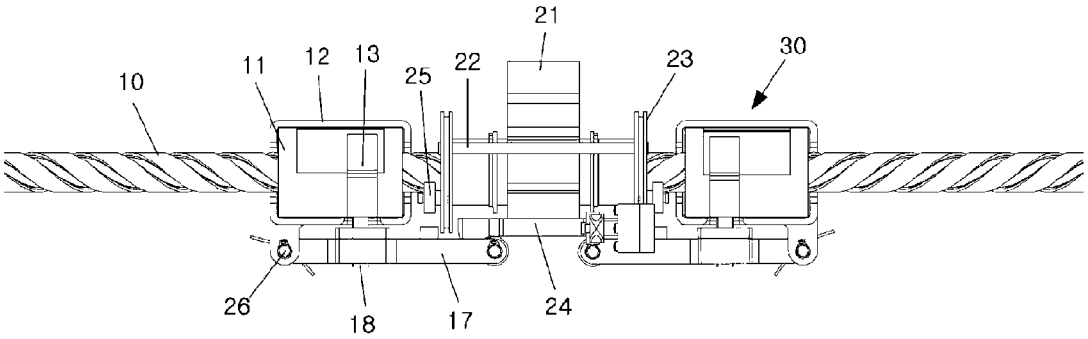
FIG. 3 is a plan view showing the electric door lock of FIG. 2 which was closed.
Figure 4:
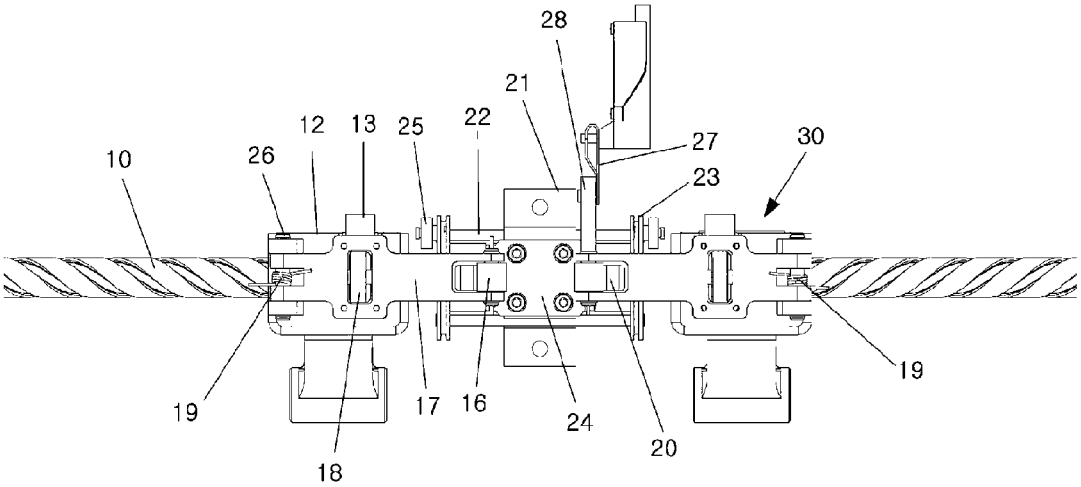
FIG. 4 is a front view showing the electric door lock of FIG. 2 which was closed.

FIG. 1 is a perspective view showing an electric door lock according to an embodiment of the present invention when it is being closed, FIG. 2 is a perspective view showing the electric door lock according to an embodiment of the present invention when it was completely closed, FIG. 3 is a plan view showing the electric door lock of FIG. 2 which was closed, and FIG. 4 is a front view showing the electric door lock of FIG. 2 which was closed.

Figure 5:
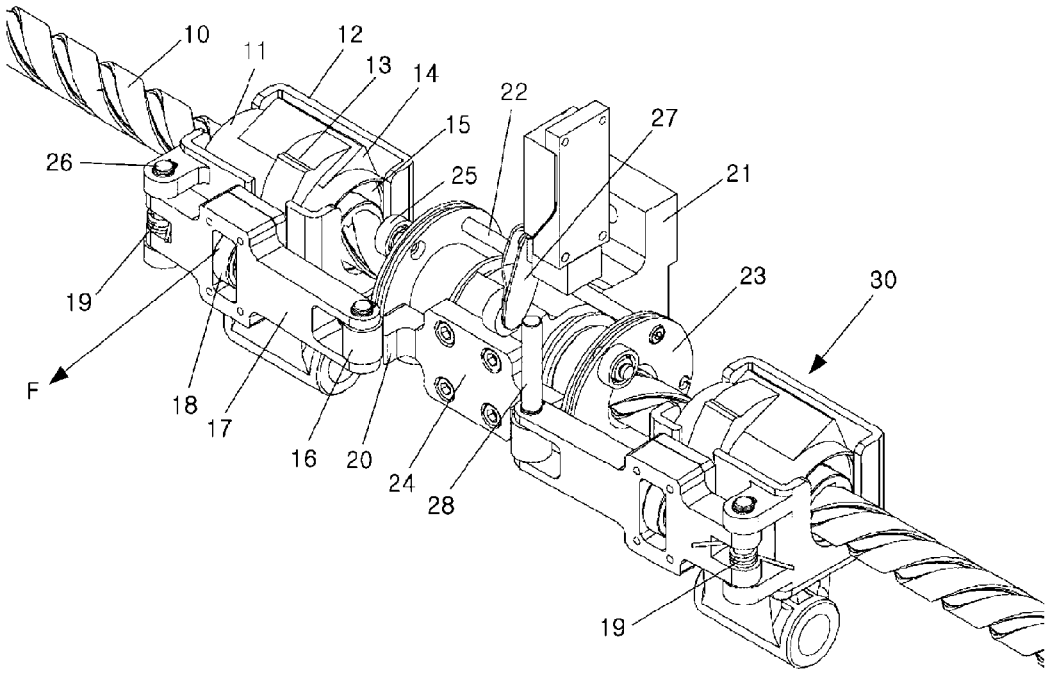
FIG. 5 is a perspective view showing an electric door lock according to an embodiment of the present invention when it starts opening.
Figure 6:
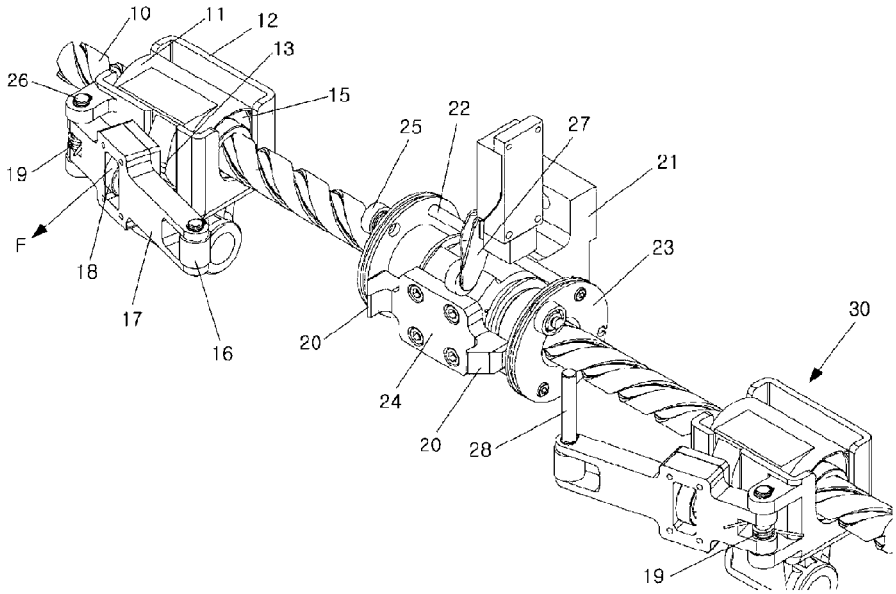
FIG. 6 is a perspective view showing an electric door lock according to an embodiment of the present invention when it is being opened.
Figure 7:
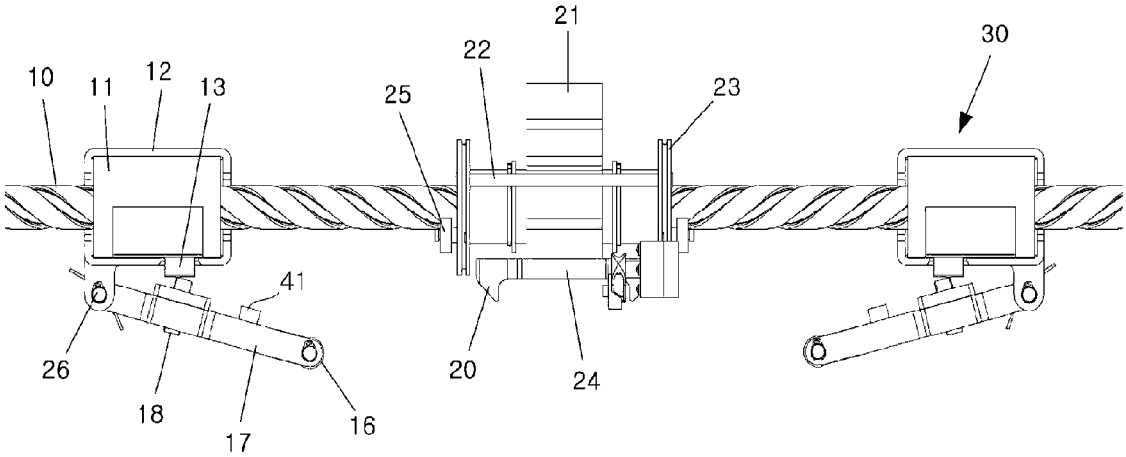
FIG. 7 is a plan view showing the electric door lock of FIG. 6 which was opened.
Figure 8:
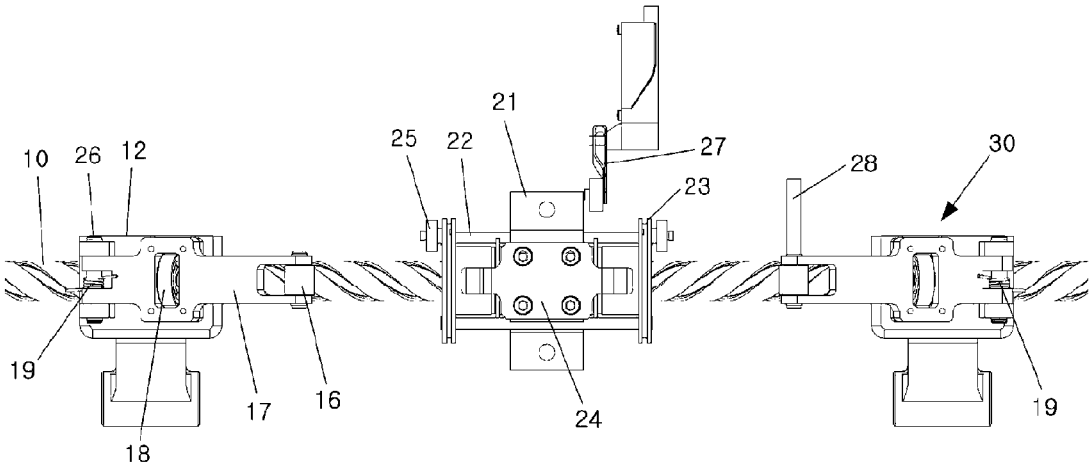
FIG. 8 is a front view showing the electric door lock of FIG. 6 which was opened.

FIG. 5 is a perspective view showing an electric door lock according to an embodiment of the present invention when it starts opening, FIG. 6 is a perspective view showing an electric door lock according to an embodiment of the present invention when it is being opened, FIG. 7 is a plan view showing the electric door lock of FIG. 6 which was opened, and FIG. 8 is a front view showing the electric door lock of FIG. 6 which was opened.

Figure 9:
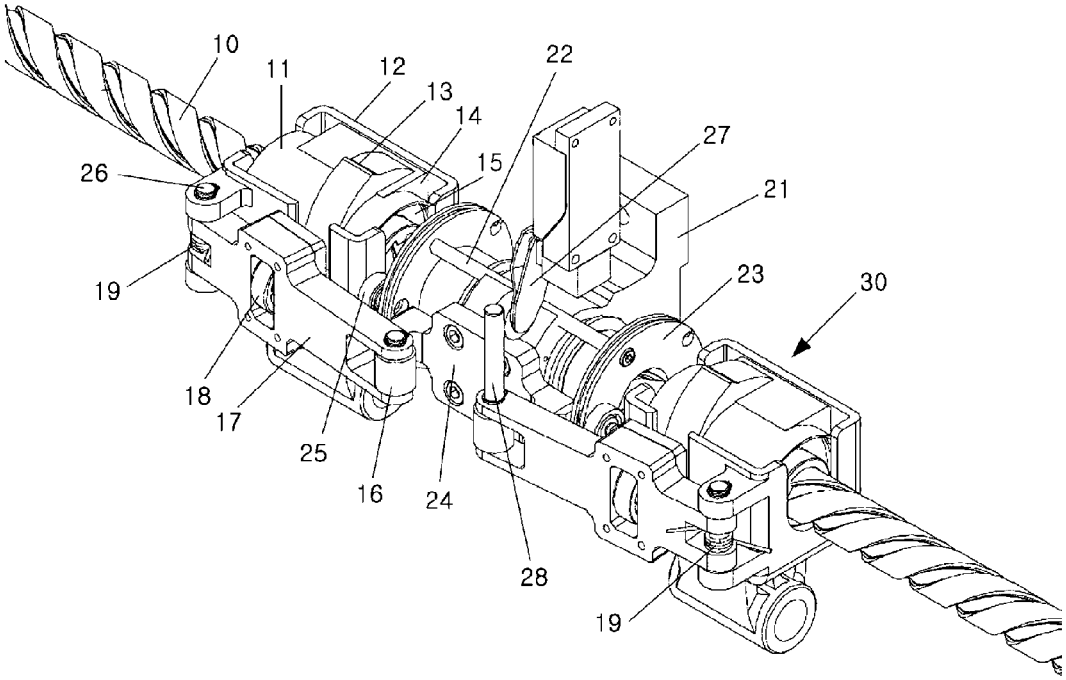
FIG. 9 is a perspective view showing an electric door lock according to an embodiment of the present invention when it is being released from its emergency-locked state.
Figure 10:
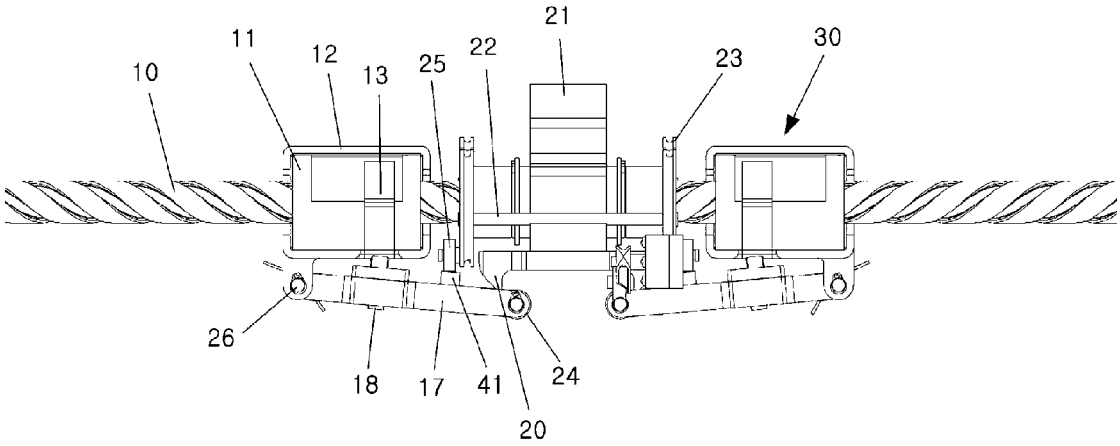
FIG. 10 is a plan view showing the electric door lock of FIG. 9 when it is being released from its emergency-locked state.

FIG. 9 is a perspective view showing an electric door lock according to an embodiment of the present invention when it is being released from its emergency-locked state, and FIG. 10 is a plan view showing the electric door lock of FIG. 9 when it is being released from its emergency-locked state.

As shown in FIGS. 1 to 10, the electric door lock which is adapted to at least one electric door body (not shown) that is slidably movable includes: a locking switch 27 provided in the door body for checking the locked state of the door body when the door body is closed; a pair of screws 10 capable of rotating forwards and rearwards and disposed parallel with each other in one side of the door frame (not shown) in the direction towards which the door body slides; a pair of locking hooks 20 provided in a door frame 2 or a screw-fixing housing 21 in the proximity of the screws; and a sliding unit 30 including a locking lever 17 having a locking roller 16 coupled to the locking hook 20 when the door body is closed, and rotatably mounted therein, a locking lever-pressing part 13 pressing down a roller 18 of the locking lever 17 such that the locking roller 16 of the locking lever is released from the locking hook 20, and a locking switch-pressing part 28 actuated to operate the locking switch 27 such that a locking signal is generated by the locking switch, wherein one end thereof is rotatably connected to the screw and the other end thereof is connected to the door body. The locking lever 17 is elastically biased towards the direction against which the locking lever approaches the locking hook 20 by means of e.g. a locking lever-pressing spring 19. The locking hook 20 includes an inclined section provided in the outside thereof at a certain angle in the direction in which the electric door body is closed, such that a locking roller 16 of the locking lever 17 is smoothly coupled to the locking hook 20, and a vertical end formed at the utmost position of the inclined section such that the vertical end extends in the direction that intersects the direction in which the door body slides. In order to allow the locking roller 16 of the locking lever 17 to smoothly latch onto and unlatch from the locking hook 20, the boundary between the inclined section and the vertical end of the locking hook may preferably be formed into a round.

According to the electric door lock of the present invention, as shown in FIG. 1, when the sliding unit 30 moves in the direction in which it is closed so that the locking roller 16 of the locking lever 17 meets the locking hook 20, the locking roller 16 moves at an inclined angle of the locking hook 20 in the reverse of the direction of the locking lever-pressing spring 19 so that it rolls upwards along the inclined section of the locking hook 20 and vertically rolls off from the utmost position of the inclined section of the locking hook 20, i.e. to the locked position shown in FIG. 2. Here, the locking switch-pressing part 28 actuates the locking switch 27 to operate so as to generate a locking signal, which in turn is transmitted to a user, finally completing the locking stroke of a door.

As shown in FIG. 1, the locking switch 27 may be coupled to the upper portion of the door frame or a screw-fixing housing 21. Since the locking switch 27 is adapted to a pressure-sensitive sensor that is actuated by the operation, i.e. the pressing of the locking switch-pressing part 28, thereby generating the locking signal, it may preferably be coupled to the locking lever 17. Naturally, this is only one embodiment. That is, while the present embodiment has illustrated the configuration in which when the door body is closed, the locking switch-pressing part 28 is concurrently rotated at a certain angle to actuate the locking switch 27, alternative embodiment is possible in which the locking switch 270 is disposed as e.g. a proximity sensor at the position closer to the door frame 2 than the position of FIG. 1, so that when the locking switch-pressing part 28 rotates and approaches the locking switch 27, the locking switch can then only generate a locking signal. However, so long as when the door body is closed, the reliability of the locking function can be secured, any method may be adapted.

The screw 10 is an element that transmits a practical driving force from a motor (not shown) to the electric door body in order to open or close the electric door body.

In the present embodiment, since a pair (set) of electric door bodies 1 is provided, a pair of screws 15 is also provided. Here, sine the pair of electric door bodies 1 is opened or closed in opposite directions to each other, the pair of screws 15 has threads that extend in opposite directions to each other. That is, in FIGS. 2 and 3, the left side screw 15 has the right-side thread, whereas the right side screw 15 has the left-side thread. Since such screws 15 transmit a practical driving force to the electric door body 1, they are connected to a drive shaft (not shown) of the motor in order to rotate forwards or rearwards. For reference, opening/closing of the door may be manually controlled by a user, or otherwise may be automatically controlled.

The sliding unit 30 is a unit wherein one end thereof is rotatably screwed to the screw 10 and the other end thereof is connected to the door body, serving to open/close the door body following the transmission of the rotating power of the screw 10 that is rotating to the door body.

The sliding unit 30 of the present embodiment advantageously has a very simple configuration because in addition to detailed elements described below, the locking switch-pressing part 28 that actuates the locking switch 27 and the locking lever 17 having the locking roller 16 that interacts with the locking hook 20 are formed into a single piece.

More specifically, according to the present embodiment, since most parts other than the screw-fixing housing 21 are integrated with the sliding unit 30, the door lock may have a simple structure, ensure the reliability of a locking function, reduce a danger of a failure and an operation error, and be easy to fabricate and maintain, saving the cost for the fabrication and maintenance relative to the cost taken in the related art.

The sliding unit 30 may include a transfer nut lump rotatably screwed to the screw 10 such that it is movable in the longitudinal direction of the screw 10, a transfer nut lump housing 12 that partially surrounds and supports the transfer nut lump such that the transfer nut lump is able to rotate at a certain angle, while surrounding and supporting a transfer nut 11, a locking lever 17 that has the locking lever roller 18 and the locking roller 16 and is connected to one side of the transfer nut lump housing 12 by means of a locking lever hinge 26, a link that connects the transfer nut lump housing 12 and a hanger (not shown), and the hanger that connects the link and the door body.

The transfer nut lump includes a screw hole through which the screw 10 is directly screw-coupled and which has a thread that is formed to correspond to that of the screw 10, the transfer nut 11 that converts a rotating motion of the screw into a linear motion of the sliding unit, the locking lever-pressing part 13 that moves the locking lever 17 including the locking lever roller 18 to the locked position, and a transfer nut support 14 that is integrated with or attached to the transfer nut so as to support the transfer nut lump such that it is rotatable at only a certain angle. The locking lever-pressing part 13 may have the shape of a disc with a certain thickness, with a protrusion formed in one side. Here, the disc of a certain thickness may be eccentrically mounted to the center of an axis of the screw 10. In addition, the locking lever may preferably further include the locking lever roller that is brought into contact with the locking lever-pressing part so that the locking lever-pressing part and the locking lever roller roll over relative to each other.

The transfer nut 11 is an element that is screw-coupled to the screw 10. Thus, as the screw 10 rotates, the transfer nut lump housing 12 connected to the side of the door body can be moved along the longitudinal direction of the screw 10. As such, the transfer nut 11 provided in the transfer nut lump housing 12 can be moved along the longitudinal direction of the screw 10, so that the door body connected to the transfer nut lump housing 12 can also be actuated.

The transfer nut lump housing 12 is an element that partially surrounds and supports the transfer nut lump. Since the transfer nut 11 and the locking lever-pressing part 13 should interact with the locking lever roller 18 while being operated, i.e. being rotated in the state of being connected to the transfer nut lump, the transfer nut lump housing 12 is provided without interfering with the operation of the transfer nut 11 and the locking lever-pressing part 13. The transfer nut lump housing 12 has an opening in one side of a body of the transfer nut lump housing 12 such that it allows the locking lever-pressing part 13 to move towards the locking lever roller 18.

The locking lever-pressing part 13 is actuated such that when the transfer nut lump is transferred in the direction in which the sliding door is opened, it is rotated together with the transfer nut lump so as to force the locking lever roller 18 to move, thereby allowing the locking roller 16 to unlatched from the locking hook 20.

The transfer nut support 14 has the shape of a right angled section in one side of the transfer nut lump, thereby serving to support the transfer nut lump such that the transfer nut lump cannot rotate at a certain angle or more when the transfer nut lump is in the locked or opened state.

The locking lever 17 is connected with the transfer nut lump housing 12 by means of the locking lever hinge 26 so that it can be moved by a certain distance in the direction perpendicular from the advancing-direction of the sliding door while rotating about the locking lever hinge. Specifically, the locking lever may include the locking lever roller 18 and the locking roller 16. Here, the locking lever roller is designed such that when the transfer nut including the locking lever-pressing part 13 is rotated, it is brought into contact with the locking lever-pressing part 13 to allow the locking lever 17 to be moved by a certain distance while being rotated about the locking lever hinge 26. The locking roller 16 serves to perform an actual locking operation in association with the operation of the locking switch-pressing part 28 and the locking hook 20.

The locking lever 17 may be provided such that it is elastically biased towards the direction in which the locking roller 16 is coupled with the locking hook in the direction in which the door is closed.

The transfer nut lump housing 12 may be designed to surround and support the transfer nut, to be connected, in one side thereof, with the locking lever 17 including the locking lever roller 18 and the locking roller 16, and to partially surround and support the transfer nut lump such that the transfer nut lump is rotatable at a certain angle.

The locking hook 20 serves to perform the locking operation in association with the operation of the locking roller 16. The locking hook 20 is attached to or integrated with a locking hook-fixing plate 24, or otherwise may be attached to the screw-fixing housing 21 or other proper site (if there is spatial restriction).

The electric door lock according to an embodiment of the present invention may include an emergency release mechanism that can release the locked state of the door lock in an emergency. The emergency release mechanism includes an emergency release roller 25 and a mounting plate for the emergency release roller 23. The mounting plate 23 for the emergency release roller is attached to the screw-fixing housing 21 such that it is rotatable at a certain angle relative to the screw-fixing housing. In addition, the mounting plate is coupled with the emergency release roller 25, so that in an emergency release situation, it is rotated at the same angle as the rotated emergency release roller 25 so as to allow the emergency release roller 25 to come into contact with the inner protrusion 41 of the locking lever 17 and move the inner protrusion 41 forwards. Thus, the locking roller 16 can be moved by a certain distance in the direction in which the locking roller 16 is separated away from the locking hook 20, even though the locking lever-pressing part 13 does not move the locking lever roller 18 of the locking lever 17 in the forward direction. A connecting pin 23 connects the left, right mounting plates 23 for the emergency release roller together, so that it allows the left, right mounting plates 23 to be rotated at the same angle.

In an embodiment of the present invention, the door frame (not shown) is a plate to which the door body is attached such that the door body is slidably moved along the plate. The door frame may be made from a metal frame for securing sufficient hardness.

Subsequently, a description will be made of the operation of the electric door lock while exemplifying a railway train.

First, the closing operation of the electric door lock will be described with reference to FIGS. 1 to 4.

FIG. 1 is a perspective view showing an electric door lock according to an embodiment of the present invention when it is being closed, FIG. 2 is a perspective view showing the electric door lock according to an embodiment of the present invention when it was completely closed, FIG. 3 is a plan view showing the electric door lock of FIG. 2 which was closed, and FIG. 4 is a front view showing the electric door lock of FIG. 2 which was closed.

When the screw 10 rotates in the forward or reverse direction by the operation of a motor, the door body is opened or closed following the forward or reverse rotation of the screw 10.

In order to close the door body, as shown in FIGS. 1 and 2, the screw 10 is manipulated to be rotated in the reverse direction. Here, the locking lever 17 is applied with the force in the direction opposite to the direction in which the door body is opened, such that locking lever-pressing part 13 does not push the locking lever roller 18, but the locking lever-pressing spring 19 performs the locking operation such that the locking roller 16 of the locking lever 17 is operated in association with the locking hook 20.

That is, as shown in FIG. 1, when the sliding unit moves in the closed direction so that the locking roller 16 of the locking lever 17 meets the locking hook 20, the locking roller 16, the locking roller 16 is rotated at a certain angle along the inclined section of the locking hook 20 while moving in the reverse direction of the force exerted by the locking lever-pressing spring 19, such that it climbs over along the inclined section of the locking hook 20 and rolls off vertically from the utmost position of the inclined section of the locking hook 20, i.e. to the locked position shown in FIG. 2. Here, the locking switch-pressing part 28 actuates the locking switch 27 to operate so as to generate a locking signal, which in turn is transmitted to a user, finally completing the locking stroke of a door. Of course, since this state is obtained in the process of finally checking the locked state, it is the state in which the closing signal was already transmitted from the closing switch before the locking signal is not generated.

like this, when the closing signal from the closing switch (not shown) and the locking signal from the locking switch 27 are transmitted to the user's control system, the closing stroke of the door is then only completed. Here, since the locking roller 16 was already disposed inside the locking hook 20, even though the passengers intend to open the door body, the door body is still held in the locked state so that the door body cannot be opened.

Next, the opening operation of the electric door lock of the present invention will be described with reference to FIGS. 5 to 8.

FIG. 5 is a perspective view showing the electric door lock when it starts opening, FIG. 6 is a perspective view showing the electric door lock when it is being opened, FIG. 7 is a plan view showing the electric door lock of FIG. 6 which was opened, and FIG. 8 is a front view showing the electric door lock of FIG. 6 which was opened.

In order to allow the locking lever-pressing part 13 to actuate the locking lever roller 18 when the door body is opened, the transfer nut 11 should be rotated at a certain angle inside the transfer nut lump housing 12.

Accordingly, for example, when the door body is being opened in response to the forward rotation of the screw 10, the screw 10 is operated as shown in FIGS. 5 and 6. When the screw 10 is operated as such, due to the initial strong rotation torque, the locking lever-pressing part 13 of the transfer nut lump is rotated at a certain angle in the locked position, causing the locking lever roller 18 of the locking lever 17 to be pushed forwards (in the direction "F" shown in FIGS. 5 and 6). Then, the locking roller 16 of the locking lever 17 unlatched from the locking hook 20, being released from its locked state and performing the opening operation, thereby allowing the door body to be normally opened.

When the door body is opened and closed, the door body is moved along an axis of the screw 10 while the hanger roller rolls along the hanger rail (not shown) formed on the door frame, so that the door body can be smoothly opened and closed.

Next, the operation of the emergency release mechanism of the electric door lock will be described with reference to FIGS. 9 and 10.

FIG. 9 is a perspective view showing the electric door lock when it is being released from its emergency-locked state, and FIG. 10 is a plan view showing the electric door lock of FIG. 9 when it is being released from its emergency-locked state.

As shown in FIGS. 9 and 10, when the door lock is intended to be released from its locked state in an emergency, the mounting plate 23 to which the emergency release roller 25 is attached is rotated so that the emergency release roller 25 comes into contact with the inner protrusion 41 of the locking lever 17, pushing the inner protrusion 41 in the forward direction. Accordingly, even though the locking lever-pressing part 13 does not push the locking lever roller 18 in the forward direction, the locking lever 17 is rotated about the locking lever hinge 26, so that the locking roller 16 of the locking lever 17 can unlatch from the locking hook 20, thereby releasing the locked state of the door body.

As set forth before, according to the present embodiment, the electric door lock can have a simple structure, ensure the reliability of a locking function, reduce a danger of a failure and an operation error, and be easy to fabricate and maintain, saving the cost for the fabrication and maintenance relative to the cost taken in the related art.

Like this, according to an embodiment of the present invention, the screws 10, the screw-fixing housings 21, and the sliding units 30 may be respectively provided in a pair unit, in which both elements are symmetric with each other, on the door frame (not shown). This is because the door body is provided in a pair unit such that both elements are opened/closed by being moved apart from or close to each other.

However, the scope of the present invention is not limited thereto, so a single door body can be provided in the door frame. In the case that the single door body is provided, it may suffice if the screw 10, the screw-fixing housing 21, and the sliding unit 30 respectively are concurrently provided in a single piece. Of course, even through the single door body is provided on the door frame, the embodiment can also implement the same performance as the present embodiment.

The electric door lock according to the above embodiments of the present invention may be adapted to electric doors of railway trains, screen doors of subway stations, etc.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. An electric door-locking device adapted to at least one electric door body that is able to slide comprising:

a screw capable of rotating forwards and rearwards in one side of a door frame in the direction in which the door body slides;

a locking hook provided in the proximity of the screw; and a sliding unit wherein one end thereof is rotatably connected to the screw and another end thereof is connected to the door body, wherein the sliding unit including a locking lever rotatably provided therein and having a latch for latching onto the locking hook when the electric door is closed, and a locking lever-pressing part actuated to press the locking lever such that the latch of the locking lever unlatches from the locking hooks, wherein the sliding unit comprises:

a transfer nut rotatably screwed-coupled to the screw such that it is rotatable in the longitudinal direction of the screw;

a transfer nut bundle including the transfer nut, a support for the transfer nut, and the locking lever-pressing part;

a transfer nut bundle housing partially surrounding and supporting the transfer nut bundle such that the transfer nut bundle is rotatable at a certain angle; and a locking lever hinge rotating the locking lever at a certain angle in a direction perpendicular to an advancing-direction of the sliding unit, wherein the transfer nut bundle housing comprises:

a housing body; and an opening formed to one side of the housing body such that the locking lever-pressing part is exposed to a locking lever roller.

2. The electric door-locking device of claim 1, wherein the locking lever is elastically biased towards a direction against which the locking lever approaches the locking hook.

3. The electric door-locking device of claim 1, wherein the locking lever-pressing part has a shape of a disc with a certain thickness, with a protrusion formed in one side.

4. The electric door-locking device of claim 1, wherein the locking lever-pressing part having a shape of a disc with a certain thickness is mounted eccentrically with respect to the center of an axis of the screw.

5. The electric door-locking device of claim 1, wherein the locking lever further comprising a locking lever roller that comes into contact with the locking lever-pressing part.

6. The electric door-locking device of claim 1, wherein the locking lever further comprising a locking roller for latching onto the locking hook.

7. The electric door-locking device of claim 1, wherein the locking hook is provided in a position of proximity of the door frame or a screw-fixing housing adjacent to the screw.

8. The electric door-locking device of claim 1, wherein the electric door further comprises a locking switch provided in the door frame for checking the locked state of the door body when the door body is closed, and a locking switch-pressing part actuated to operate a locking switch such that a locking signal is generated by the locking switch.

9. The electric door-locking device of claim 1, wherein the locking hook comprises:

an inclined section provided in the outside thereof at a certain angle in the direction in which the electric door body is closed, such that a locking roller of the locking lever is smoothly coupled to the locking hook; and a vertical end formed at the utmost position of the inclined section such that the vertical end extends in the direction that intersects the direction in which the door body slides.

10. The electric door-locking device of claim 9, wherein a boundary between the inclined section and the vertical end of the locking hook is formed into a round.

11. The electric door-locking device of claim 1, further comprising an emergency release mechanism.

12. The electric door-locking device of claim 11, wherein the emergency release mechanism comprises an emergency release roller and an emergency release roller plate.

13. The electric door-locking device of claim 1, wherein the door body, the screw, the locking hook, the emergency release roller, the emergency release roller plate, and the sliding unit are respectively provided in a pair of units, in which the pair of units are symmetric with each other, on the door frame.

14. The electric door-locking device of claim 1, wherein a second screw is provided having threads extending opposite to the screw.

15. The electric door-locking device of claim 1, wherein the electric door lock further comprises a closing switch provided in the door body so as to generate a signal indicative of the closed state of the door body when the door body was closed.

16. The electric door-locking device of claim 1, wherein a space in which a screw nut bundle can move in a sliding direction of the door body or in a direction that vertically intersects the sliding direction in connection with a screw nut bundle housing is further provided between the screw nut bundle and the screw nut bundle housing.

17. An electric door system comprising the electric door-locking device according to claim 1.

* * * * *